United States Patent [19]

Woods

[11] 4,434,812

[45] Mar. 6, 1984

[54] FLUIDIC GAIN CHANGER

[75] Inventor: Robert L. Woods, Arlington, Tex.

[73] Assignee: The United States of America as represented by the Secretary of the Navy, Washington, D.C.

[21] Appl. No.: 486,134

[22] Filed: Apr. 18, 1983

[51] Int. Cl.[3] ..... F15C 3/00; F15C 1/08

[52] U.S. Cl. ..... 137/829; 137/839

[58] Field of Search ..... 137/829, 839

[56] References Cited

U.S. PATENT DOCUMENTS

| | | | |
|---|---|---|---|
| 3,283,766 | 11/1966 | Horton | 137/829 |
| 3,548,849 | 12/1970 | Purcell | 137/81.5 |
| 3,557,816 | 1/1971 | Small | 137/829 |
| 3,927,694 | 12/1975 | Struttmann et al. | 137/829 |
| 3,934,603 | 1/1976 | Avery | 137/83 |
| 4,256,015 | 3/1981 | Tippetts et al. | 137/829 |

*Primary Examiner*—A. Michael Chambers

*Attorney, Agent, or Firm*—R. F. Beers; F. I. Gray

[57] ABSTRACT

A fluidic gain changer uses a fluid jet to mechanically deflect between two sets of fluidic receivers. A planar fluidic amplifier has its power jet, control jets and interaction regions bounded together to form a flexible tab than can be deflected in the third dimension. Two sets of receivers are located downstream and are offset so that the jet is evenly divided into the two sets of receivers when the tab is centered. Deflection of the tab increases the gain in one set of receivers while decreasing the gain in the other set of receivers.

6 Claims, 3 Drawing Figures

FLUIDIC GAIN CHANGER

BACKGROUND OF THE INVENTION

1. Field of the Invention

The present invention relates to fluidic control circuits, and more particularly to a fluidic gain changer applicable to V/STOL flight control.

2. Description of the Prior Art

Gain change is a function often required in fluidic circuits. The needs vary from a simple gain adjustment to account for circuit-to-circuit variations to a gain change as a scheduled function of a secondary variable. Often the required range of change is only slight, but it could be vary large in some applications such as for V/STOL. Changing gains as a linear function of another variable results in multiplication which is occasionally required in fluidic circuits.

Currently there are no fluidic devices ideally suited to the V/STOL flight control application. There are numerous concepts for gain changes that change gain over a limited range, i.e., less than 9 to 1, but only a few have higher performance on the gain range, i.e., greater than 10 to 1. Whereas a complementary gain charger having two outputs that change gain in the opposite fashion could be built as a combination of two independent gain changers, no complementary device exists.

Therefore, it is desired to have a two-channel complementary fluidic gain changer having a conventional fluidic input pressure signal and gains that can be adjusted from zero to maximum by means of a mechanical position input, the gain changer being capable of a 50 to 1 range.

SUMMARY OF THE INVENTION

Accordingly, the present invention provides a fluidic gain changer in which a fluid jet is mechanically deflected between two sets of fluidic receivers. A planar fluidic amplifier has its power jet, control jets and interaction regions bounded together to form a flexible tab that can be deflected in the third dimension. Two sets of receivers are located downstream and are offset so that the jet is evenly divided into the two sets of receivers when the tab is centered. Deflection of the tab increases the gain in one set of receivers while decreasing the gain in the other set of receivers.

Therefore, it is an object of the present invention to provide a fluidic, complementary gain changer having a gain change range of 50 to 1.

Other objects, advantages and novel features of the present invention will be apparent from the following detailed description when read in conjunction with the appended claims and attached drawing.

DESCRIPTION OF THE PREFERRED EMBODIMENT

Figure 1:
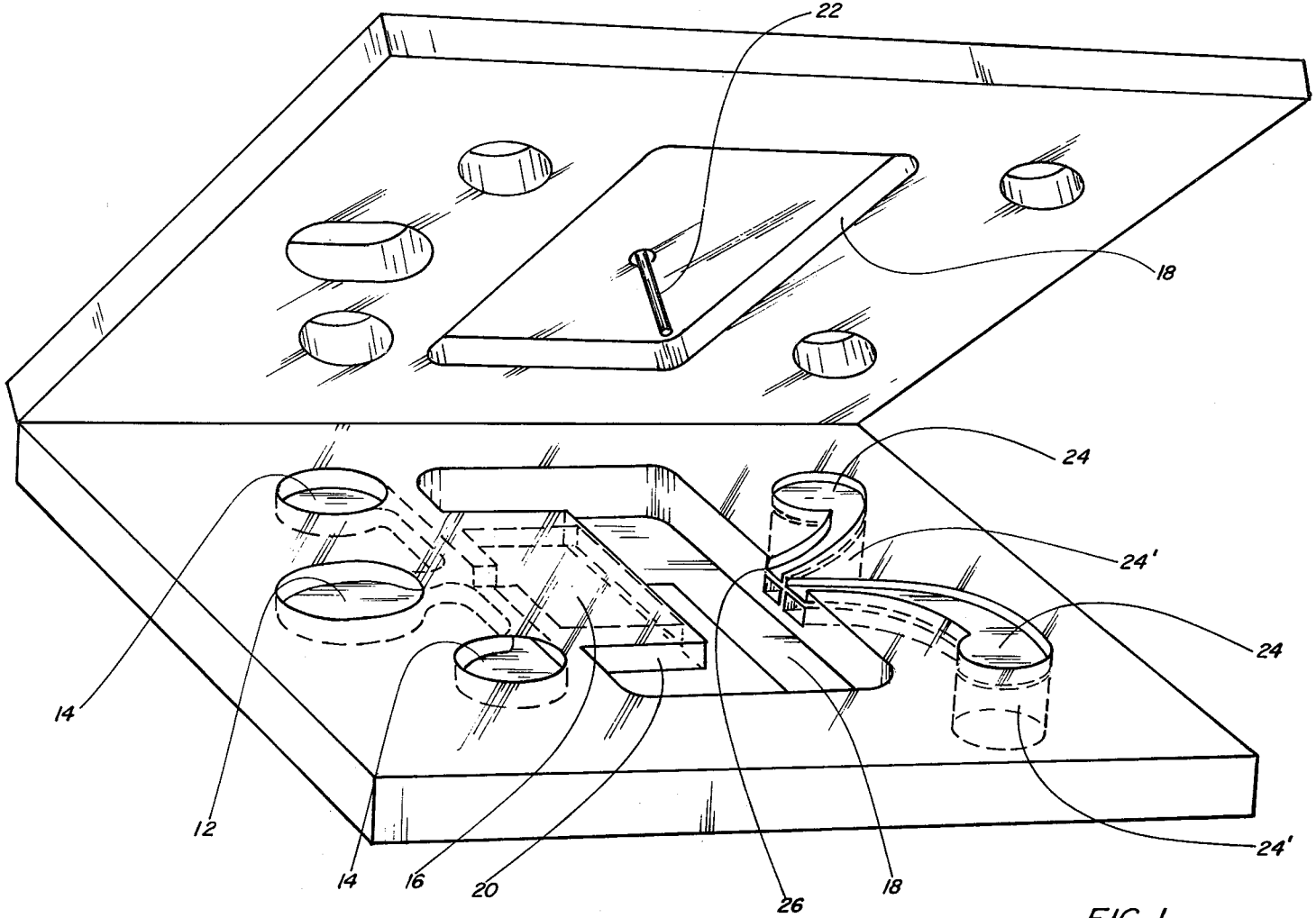
FIG. 1 is a conceptual representation of a fluidic gain changer according to the present invention.
Figure 3:
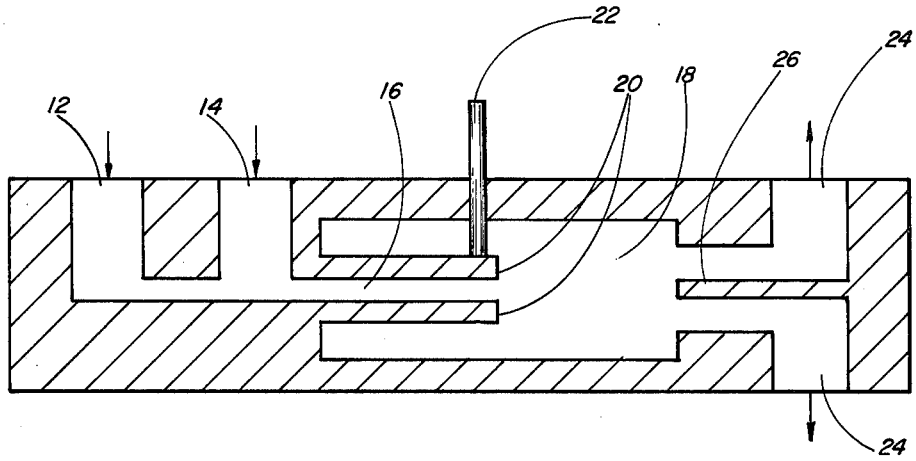
FIG. 3 is a side plan view of the geometry of the flex chamber.
Figure 2:
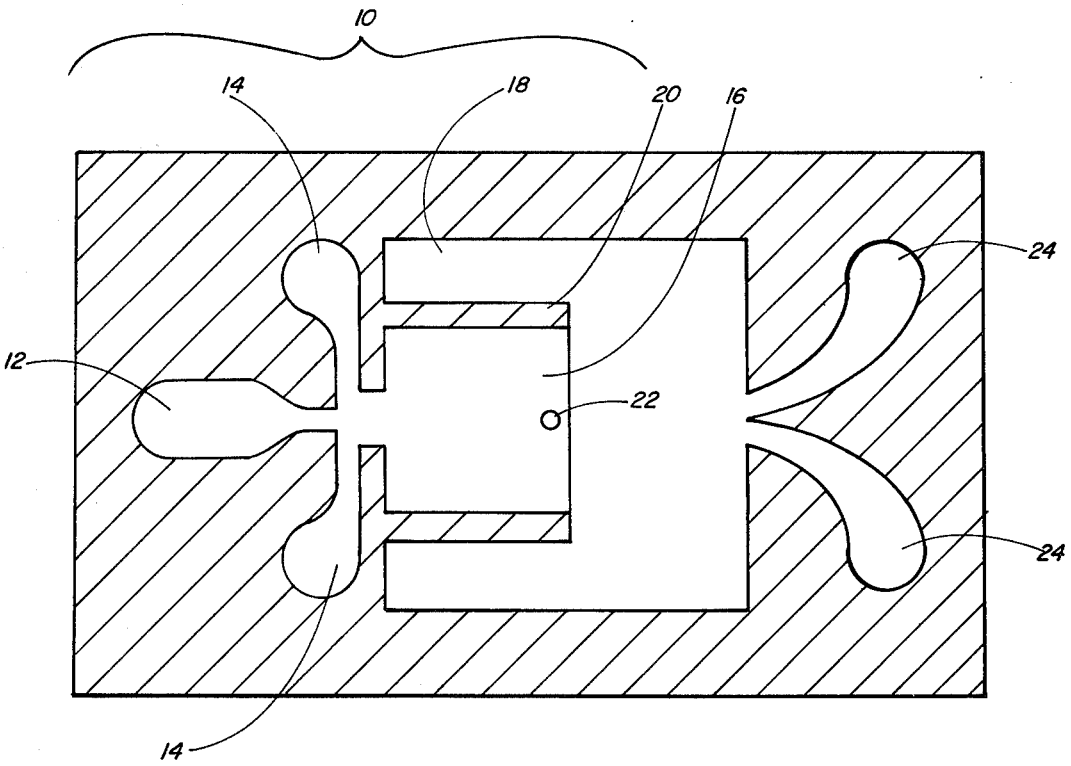
FIG. 2 is a top plan view of the geometry of the flex chamber for the fluidic gain changer.

Referring now to FIGS. 1-3 the geometry of a fluidic gain changer is shown. A planar fluidic amplifier 10 is defined by a power jet 12, control jets 14 and an interaction region 16. The interaction region 16 extends into a vent region 18 to form a flexible tap 20 which can be deflected in the third dimension by any suitable means such as a rod 22 which extends through the vent region above the flexible tap and is rigidly connected to the flexible tab. Downstream from the planar fluidic amplifier 10 are two sets of receivers 24, 24' which are offset so that the jet from the interaction region 16 is evenly divided between the two sets of receivers when the tab 20 is centered. A laminate 26 separates the upper set of receivers 24 from the lower set of receivers 24'. The laminate 26 and laminates that form the receivers 24, 24' and venting region 18 are sized to produce the gain symmetry desired as the tab 20 deflects. The rod 22 may be replaced with an external lever effect which eliminates the sealing and push-pull actuation problems with the rod actuation technique. Hinging or other fabrication techniques also are applicable.

In operation the jet flow from the interaction area 16 is deflected by moving the tab 20 either up or down. For example as the tab 20 is deflected upward, the jet is directed toward the upper set of receivers 24 so that the gain between the fluidic input and the upper output is increasing to a maximum while the gain to the lower set of receivers is decreasing to a minimum. The result is a complementary fluid gain changer having linear and symmetrical gain variations for the two channels.

A single-axis gain trimming device can be built in a similar deflector-tab fashion but with a single set of receivers on the jet centerline. Vents around the receivers would be used for jet venting when at less than maximum gain. This gain trim application is better than current approaches since it requires a single input parameter adjustment that is insensitive to Reynolds number variations.

Although the gain control is a mechanical position, a diaphragm actuator may be used to position the tab 20 in response to a pressure signal if a pressure-controlled gain change is desired such as gain change versus Mach number. The fluidic gain changer is applicable to both liminar flow and turbulent flow operations, and is well-suited for a variety of applications in fluidic circuits.

Thus, the present invention provides a fluidic gain changer having a planar fluidic amplifier and one or more sets of receivers, the gain being controlled by the deflection of a flexible tab for linear response. The device may be used as a complementary fluid gain changer with two sets of receivers offset from each other, as a gain trim adjuster with a single set of receivers, or for other fluidic circuits.

What is claimed is:

1. A fluidic gain changer comprising:

a planar fluidic amplifier, having a power jet and means for deflecting within a plane the fluidic jet from said power jet;

a pair of complementary fluidic receivers downstream from said planar fluidic amplifier, each of said pair of complementary fluidic receivers being offset symmetrically above and below said plane; and means for deflecting the fluidic jet from said planar fluidic amplifier in a direction perpendicular to said plane to linearly vary the gain between said pair of complementary fluidic receivers in a complementary manner.

2. A fluidic gain changer is recited in claim 1 wherein said deflecting means comprises:

a flexible tab from which the fluidic jet from said planar fluidic amplifier flows; and means for moving said flexible tab perpendicular to said plane to deflect the fluidic jet from said planar fluidic amplifier.

3. A fluidic gain changer as recited in claim 2 wherein said moving means comprises a rod connected to said flexible tab such that movement of said rod in a push-pull manner moves said flexible tab in the third dimension.

4. A fluidic gain changer as recited in claim 2 wherein said moving means comprises means for generating a lever effect on said flexible tabe to move said flexible tab in the third dimension.

5. A fluidic gain changer as recited in claim 2 wherein said moving means comprises a diaphragm actuator to move said flexible tab in the third dimension in response to a pressure signal.

6. A fluidic gain changer as recited in claim 3 wherein said flexible tab comprises:

a vent region between said planar fluidic amplifier and said pair of complementary fluidic receivers; and an interaction region which is connected at one end to said planar fluidic amplifier in a cantilever manner and which extends into said vent region toward said pair of complementary receivers such that the fluidic jet from said planar amplifier flows through said interaction region to said pair of complementary receivers, the amount of the fluidic jet entering each of said pair of complementary receivers being determined by the amount of deflection of the free end of said interaction region.

* * * * *